US006134520A

United States Patent [19]

Ravishankar

[11] Patent Number: 6,134,520

[45] **Date of Patent: *Oct. 17, 2000**

[54] SPLIT VECTOR QUANTIZATION USING UNEQUAL SUBVECTORS

[75] Inventor: Channasandra Ravishankar, Germantown, Md.

[73] Assignee: Comsat Corporation, Bethesda, Md.

[ * ] Notice: This patent issued on a continued prosecution application filed under 37 CFR 1.53(d), and is subject to the twenty year patent term provisions of 35 U.S.C. 154(a)(2).

[21] Appl. No.: 08/578,441

[22] Filed: Dec. 26, 1995

Related U.S. Application Data

[63] Continuation of application No. 08/133,415, Oct. 8, 1993.

[51] Int. Cl.[7] ..... G10L 5/00

[52] U.S. Cl. ..... 704/222

[58] Field of Search ..... 704/500–504, 704/200, 219, 223

[56] References Cited

U.S. PATENT DOCUMENTS

| | | | |
|---|---|---|---|
| 4,975,958 | 12/1990 | Hanada et al. | 381/36 |
| 4,980,916 | 12/1990 | Zinser | 395/2.28 |
| 5,060,269 | 10/1991 | Zinser | 381/36 |
| 5,086,471 | 2/1992 | Tanaka et al. | 395/2.31 |
| 5,208,862 | 5/1993 | Ozawa | 381/36 |
| 5,295,224 | 3/1994 | Makamura et al. | 395/2.32 |
| 5,307,441 | 4/1994 | Tzeng | 395/2.31 |

OTHER PUBLICATIONS

Kleijn et al., "An Efficient Stochastically Excited Linear Predictive Coding Algorithm for High Quality Low Bit Rate Transmission of Speech," Speech Communication 7 (1988), Elsevier Science Publishers B.V., pp. 305–316.

K. K. Paliwal et al, "Efficient Vector Quantization of LPC Parameters at 24 Bits/Frame", ICASSP 91, vol. 1, 1991 International Conference on Acoustics, Speech and Signal Processing, May 14–17, 1991, pp. 661–664.

*Primary Examiner*—David D. Knepper

*Attorney, Agent, or Firm*—Sughrue, Mion, Zinn, Macpeak & Seas, PLLC

[57] ABSTRACT

A 1200 b/s vocoder providing a high degree of speech intelligibility and natural voice quality includes a tenth-order linear prediction analyzer, a split vector quantizer for line spectral frequencies, circuitry providing voicing classification and pitch estimation, a differential pitch and gain quantizer and a multiplexer for producing an encoded word transmitted to a receptive demultiplexer. The vocoder provides a characteristic encoded word including a first codeword, a second codeword, a pitch codeword and a gain codeword, wherein the first and second codewords are selected from respective first and second codebooks having a equal number of codewords and wherein the first and second codewords represent unequal numbers of elements of respective first and second sub-vectors. A codebook populating method for a split vector quantizer vocoder is also utilized.

12 Claims, 2 Drawing Sheets

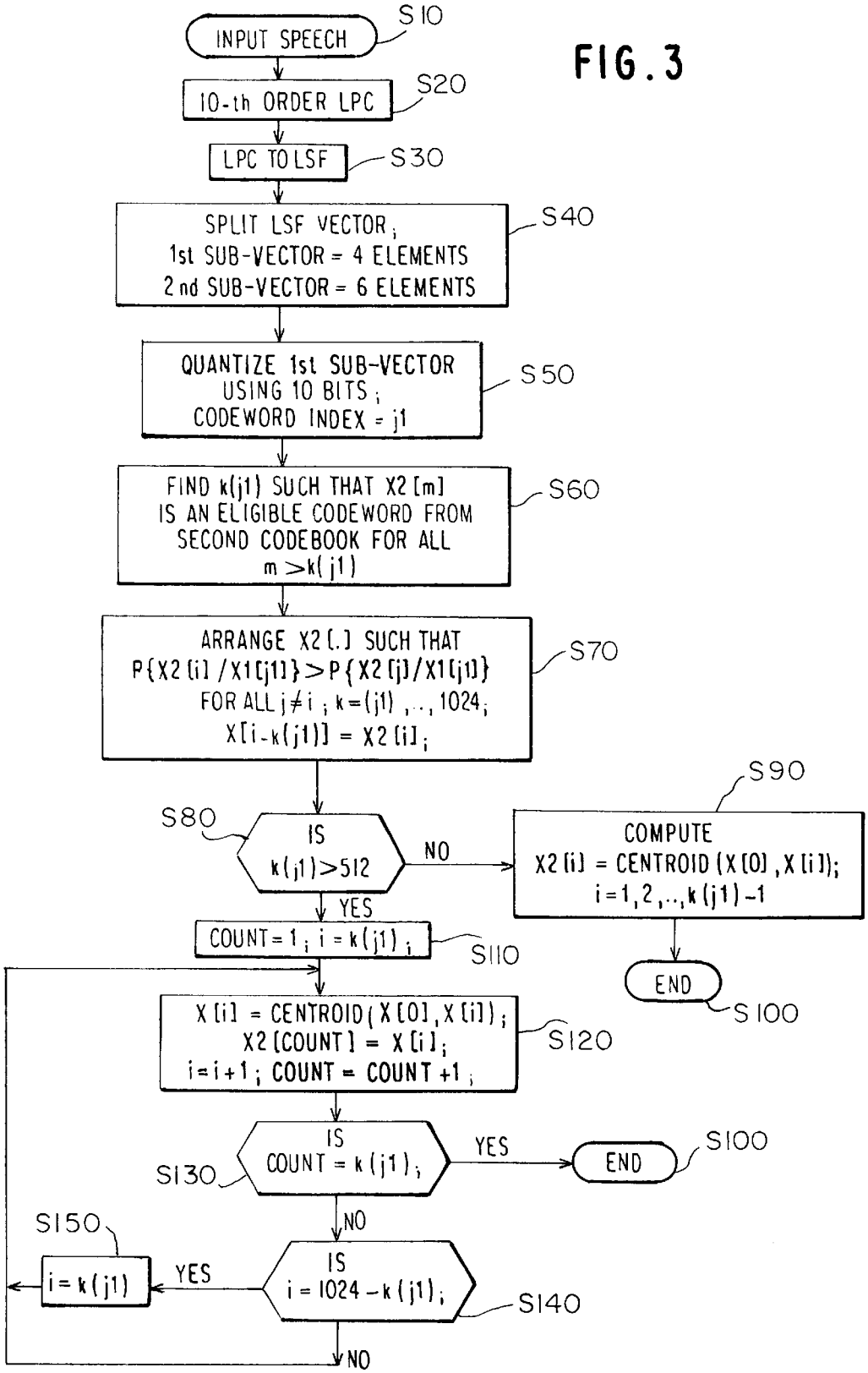
FIG. 3
INPUT SPEECH
S10
10-th ORDER LPC
S20
LPC TO LSF
S30
SPLIT LSF VECTOR;
1st SUB-VECTOR = 4 ELEMENTS
2nd SUB-VECTOR = 6 ELEMENTS
S40
QUANTIZE 1st SUB-VECTOR
USING 10 BITS;
CODEWORD INDEX = j1
S50
FIND k(j1) SUCH THAT X2[m]
IS AN ELIGIBLE CODEWORD FROM
SECOND CODEBOOK FOR ALL
m > k(j1)
S60
ARRANGE X2[.] SUCH THAT
P{X2[i]/X1[j1]} > P{X2[j]/X1[j1]}
FOR ALL j ≠ i; k=(j1),..,1024;
X[i-k(j1)] = X2[i];
S70
S80
IS
k(j1) > 512
NO
S90
COMPUTE
X2[i] = CENTROID(X[0], X[i]);
i=1,2,..,k(j1)-1
END
S100
YES
COUNT = 1; i = k(j1);
S110
X[i] = CENTROID(X[0], X[i]);
X2[COUNT] = X[i];
i=i+1; COUNT = COUNT+1;
S120
IS
COUNT = k(j1);
S130
YES
END
S100
NO
S150
i = k(j1)
YES
IS
i = 1024 - k(j1);
S140
NO

SPLIT VECTOR QUANTIZATION USING UNEQUAL SUBVECTORS

This is a continuation of application Ser. No. 08/133,415 filed on Oct. 8, 1993.

FIELD OF THE INVENTION

The present invention relates generally to low data rate vocoders. More specifically, the present invention relates to low data rate vocoders using split vector processing whereby the coding efficiency of the vocoder is maximized. In particular, the present invention relates to low data rate encoder—decoder pairs employing split vector quantization and differential pitch and gain quantization processing. A codebook populating method for adaptively populating one of two codebooks used for encoding one sub-vector while maintaining ordered properties given the quantized value of the other sub-vector is also disclosed

BACKGROUND OF THE INVENTION

There has been an increasing interest in the development of low bit rate speech coding technologies that can operate at rates of 2400 bit per second (b/s) and below for both current military use and for future commercial applications. Although Government and industry have begun to pursue new coding methodologies which can yield high quality speech at bit rates in the 2400 b/s range, relatively less resources have been applied to efforts regarding development of a good quality 1200 b/s coding that can either be used as a stand-alone coder or as an embedded coder in a higher rate variable rate coder.

The use of Line Spectral Pair (LSP) or Line Spectral Frequency (LSF) representation for vector quantization of short-term spectral parameters is very well known. For example, U.S. Pat. Nos. 5,012,518 and 4,975,956 disclose techniques for vector quantization of LSP parameters. However, the technique described in these patents requires a significantly higher computational overhead than an alternative encoder employing split vector quantization encoding. For example, in split-vector quantization using 20 bits, a maximum of 2048 comparisons are needed to arrive at the optimal quantized LSF vector. In contrast, the conventional method of vector quantization using 20 bits requires more than a million comparisons to arrive at the optimal quantized LSF vector. LSF's are ideally suited for split vector quantization techniques due to its ordered and localized spectral sensitivity properties.

U.S. Pat. Nos. 5,187,745, 5,179,594, 5,173,941 and 5,086,475 disclose CELP vocoders.

SUMMARY OF THE INVENTION

The principal purpose of the present invention is to provide a vocoder achieving optimal coding efficiency for a given low bit transmission rate.

One object of the present invention is to provide a vocoder employing a novel populating method that improves the performance of the split-vector quantization coding.

Another object of the present invention is to provide a vocoder employing a highly efficient quantization method for encoding gain and pitch using a differential quantization method.

These and other objects, features and advantages of the present invention are provided by a 1200 b/s vocoder providing a high degree of speech intelligibility and natural voice quality. The 1200 b/s vocoder advantageously includes a tenth-order linear prediction analyzer, a split vector quantizer for line spectral frequencies, circuitry providing voicing classification and pitch estimation and a differential pitch and gain quantizer.

According to one aspect of the invention, the vocoder includes a multiplexer for producing an encoded word transmitted to a receptive demultiplexer. The vocoder provides a characteristic encoded word including a first codeword, a second codeword, a pitch codeword and a gain codeword, wherein the first and second codewords are selected from respective first and second codebooks having a equal number of codewords and wherein the first and second codewords represent unequal numbers of elements of respective first and second sub-vectors.

According to another aspect of the invention, a codebook populating method for a split vector quantizer vocoder includes the steps of (a) determining a first number of eligible codewords in original second codebook given a selected codeword from a first codebook, (b) when the first number is greater than a predetermined number, computing a second number of centroid of pairs of the codewords in the second codebook and (c) when the first number is less than the predetermined number, computing the second number of centroids by repeatedly calculating the centroids of all the pairs of codewords having a first form and then calculating the centroids of all the pairs of codewords having a second form until the second codebook is fully populated.

These and other objects, features and advantages of the invention are disclosed in or apparent from the following description of preferred embodiments.

BRIEF DESCRIPTION OF THE DRAWINGS

The preferred embodiments are described with reference to the drawings in which like elements are denoted by like or similar numbers and in which:

FIG. 3 is a flow chart illustrating the steps for populating a second codebook used in a split vector vocoder according to a preferred embodiment of the present invention.

DESCRIPTION OF THE PREFERRED EMBODIMENTS

Figure 1:
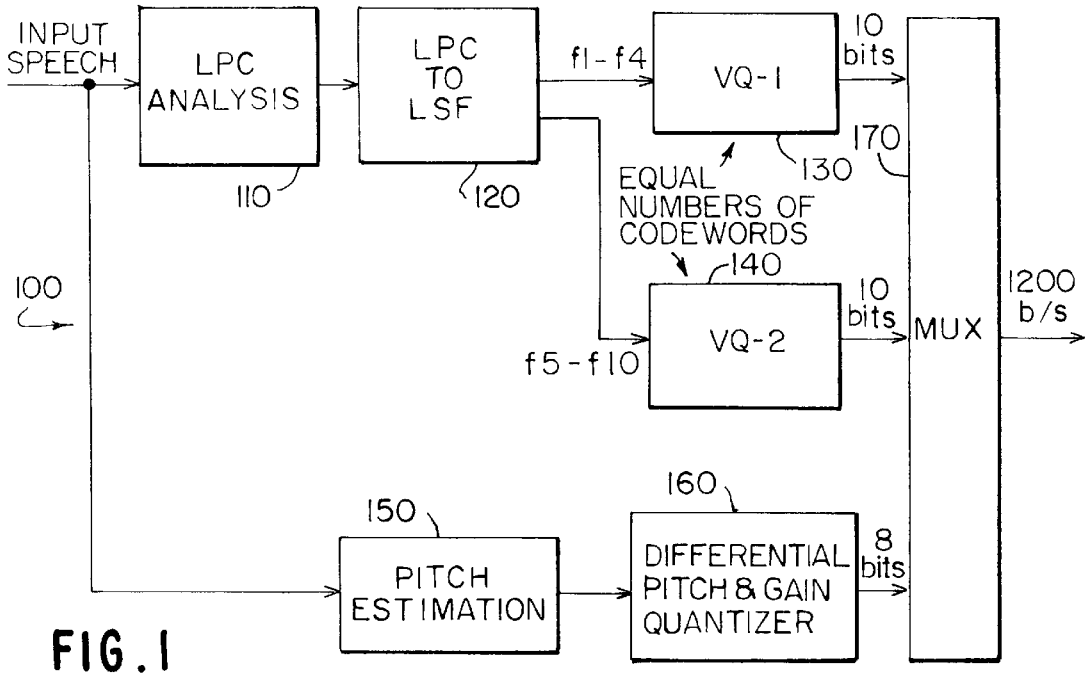
FIG. 1 is a illustrative high level block diagram which is useful in explaining the operation of the transmission side of a vocoder according to the preferred embodiment of the present invention.

Before providing detailed descriptions of the vocoder apparatus and corresponding method, a brief discussion illustrating conventional vocoders contrasted with the features of the present invention will be provided.

Split vector quantization of line spectral frequencies (LSF) was first described in the article by Paliwal et al. entitled "Efficient Vector Quantization of LPC Parameters in 24 bits/frame", Proceeding of ICASSP, pp 661–664, 1991, which article is incorporated herein by reference for all purposes. In the article, the LSF vector consisting of ten line spectral frequencies was split into two sub-vectors of dimensions 4 and 6, respectively. Each sub-vector was quantized using a 12 bit vector quantizer. While a major advantage of the split vector quantizer is relatively low complexity, as compared to that of an unsplit vector quantizer using 24 bits, the split vector quantized has several significant disadvantages. One of the major disadvantages is that, in order to satisfy the ordered property of the quantized LSF vector (and hence to preserve the stability of the LPC synthesis filter), only a small number of codewords in the second codebook are eligible for vector quantization of the second sub-vector for a given quantized first sub-vector. In short, of the 12 bits that are available to quantize the second sub-vector, a number of the codewords cannot be used.

In contrast, the present invention performs split vector quantization, whereby each sub-vector is quantized using a 10 bit vector quantizer. Preferably, a method of populating the second codebook is employed so that for any given quantized first sub-vector, the number of eligible codewords to quantize the second sub-vector is 1024. Thus, the inefficiency discussed with respect to the Paliwal et al. technique can be avoided.

Moreover, the codebook populating method advantageously can be made adaptive without overheads, i.e., with the arrival of every new LSF vector to be quantized, the populating method can be updated without transmitting any additional information to the decoder.

Conventionally, pitch and gain quantizations are often encoded using scalar quantization, wherein seven to eight bits are used to represent each characteristic. This extracts a significant penalty when bit rates in the range of about 1200 b/s are used. A differential quantization method advantageously can be used for pitch and gain encoding, preferably using 4 bits for encoding each characteristic. In addition, non-uniform quantization of the differential pitch and uniform quantization of differential gain advantageously can be performed. It will be noted that such encoding advantageously reduces the total number of bits required to transmit pitch and gain information, while degrading the output quality to a minimum extent.

The 1200 b/s vocoder according to the present invention includes a tenth-order linear prediction analyzer, split vector quantization circuitry for quantizing line spectral frequencies, neural network based voicing decision and pitch estimation circuitry, a differential pitch and gain quantizer, as explained in greater detail below with respect to FIGS. 1 and 2. Advantageously, one of the codebooks of the split vector quantizer is populated using an improved method to increase code utilization. Additionally, encoding pitch and gain using differential pitch and gain quantization advantageously reduces the number of bits required to transmit pitch and gain information to the decoder in the receiver half of the vocoder according to the present invention.

It will be appreciated that t hese voice coding methods implemented in the vocoder according to the present invention are critical components in the development of satellite terrestrial based mobile and portable communication systems using miniature handheld transceivers.

The present invention will now be described while referring to FIGS. 1 and 2.

As shown in FIG. 1, a transmitter 100 comprising one side of the vocoder receives an input speech signal at linear prediction coding (LPC) analyzer 10, which outputs a set of LPC coefficients to a line spectrum frequency (LSF) generator 120. Generator 120 in turn produces two split or sub-vectors including spectrum frequency f1–f4 and f5–f10. The first sub-vector is applied to vector quantizer 130 while the second sub-vector is applied to vector quantizer 140. Quantizers 130, 140 produce 10-bit codewords which are then provided to a multiplexer 170.

Advantageously, multiplexer 170 also receives the output of pitch estimation circuit 150 in response to the input speech signal. Pitch e stimation circuit 150 provides an input signal to differential pitch and gain quantizer 160, which quantizer produces an 8-bit signal, 4 of the bits representing differential pitch and 4 of the bits representing gain. The multiplexer 170 multiplexes the 28 bits thus produced to represent one frame of speech.

It will be appreciated that differential pitch encoding requires a reference pitch so that the difference between the reference and the present pitch can be calculated. It will be noted by those of ordinary skill in the art that only a limited portion of transmission stream include pitch information. Thus, when a transition occurs between an unvoiced and a voiced utterance, the pitch value, which is used as the reference value, is calculated to all 8 bits. It should be noted that the reference pitch codeword advantageously can be transmitted in a frame prior to the start of the voiced utterance, since unvoiced utterances will not contain pitch information.

Figure 2:
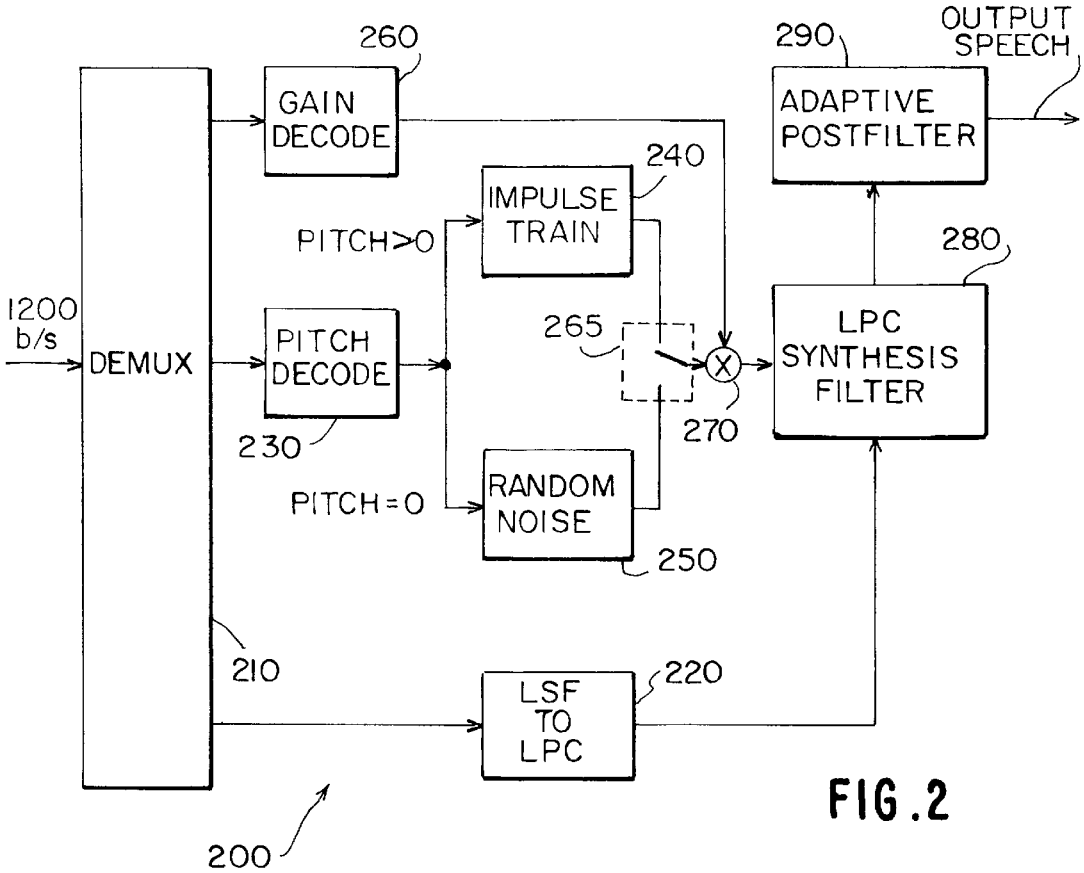
FIG. 2 is a illustrative high level block diagram which is useful in explaining the operation of the receiver side of a vocoder according to the preferred embodiment of the present invention.

FIG. 2 shows the receiving side 200 of the vocoder according to the present invention. A demultiplexer 210 receives the encoded signal from transmitter 100 and reproduces a gain signal, a pitch signal and a signal corresponding to the vector from the first and second sub-vectors. The gain decoder 260 receives the recover gain codewords and produces a corresponding gain signal. The pitch decoder 230 receives the recovered differential pitch codeword and feeds this information to an impulse train generator 240. A random noise generator 250 is connected in parallel with impulse train generator 240. A switch 265 selects one of generators, 240, 250 based on the output of pitch decoder 230. When the pitch is 0, random noise is provided to a multiplier 270 while, when the pitch is not equal to 0, the impulse train is provided by impulse train generator 240 to multiplier 270.

Preferably, the gain signal produced from gain decoder 260 is input to multiplier 270 and the product is provided to a synthesis filter 280. Filter 280 advantageously also receives the output of LSF-to-LPC decoder 220, which receives quantized vector codewords from demultiplexer 210. The signal output by multiplier 270 is filtered according to the characteristics derived from decoder 220 in filter 280 and an output speech signal is generated. Preferably, an adaptive post-filter 290 provides additional signal processing.

To achieve a bit rate of 1200 bits/s with a frame length of about 22.5 ms, approximately 28 bits are available to represent a frame of speech. It will be apparent that with 20 bits allocated for parameter quantization as described above, only 8 bits are available for representing pitch and gain information, assuming binary excitation is used at the decoder (which advantageously does not require additional information to be transmitted to the decoder). However, pitch and gain are typically quantized using scalar quantization techniques producing seven to eight bits for representing each speech characteristic.

Preferably, differential pitch and differential gain quantization is performed using 4 bits each to represent the difference between a reference value and a present value for each characteristic. The differential pitch quantization advantageously performs as robustly as full quantization of pitch values using 7 to 8 bits, since most of the time since pitch contours are smooth functions within a given utterance.

The differential quantizer is reset at the end of every voiced utterance, e.g., voiced to unvoiced and every sound to silence transition, independently. As discussed above, the pitch value of the first frame of a voiced utterance is represented using 8 bits in the previously transmitted frame, and, for the succeeding voiced frames, the difference between the pitch value of the current frame and the reconstructed value of the previous frame preferably is quantized using 4 bits. Non-uniform quantization of differential pitch values was carried out using a look-up table that is essentially linear near the origin and nonlinear for larger pitch differences. It will be noted that this is similar in concept to the A-law companding of speech used in PCM systems. At the decoder, a look-up table that reflects the expander curve advantageously can be used along with the previous reconstructed pitch value to reconstruct the pitch value of the current frame. It should be noted that nonuniform quantization of pitch values was especially necessary for representations of female speech, since the output speech exhibited reverberation when pitch values of adjacent frames, which were close to each other, were not exactly reconstructed.

Preferably, the additional 4 bits that are necessary to transmit the pitch values for the first frame of a voiced utterance are accommodated by transmitting these 4 bits during the previous frame, which frame was either silent of unvoiced.

It should be noted that in the absence of transmission errors, the pitch value for the first frame of voiced utterance is reconstructed exactly since 8 bits are more than sufficient to represent integer pitch values from 16 to 128. Re-initializing the reference pitch value at the beginning of every voiced utterance advantageously helps to avoid leakage of quantization errors from the utterance to another.

It will also be noted that gain in the Logarithm domain advantageously cab be differentially quantized using 4 bits. Again the degradation is only graceful as compared to full quantization of gain values using 7 to 8 bits, since gain contours are smooth over a given utterance. It will be noted that in most cases the gain contours are smooth within a frame. Nonuniform quantization of differential gain values advantageously is unnecessary since the output speech quality is fairly robust for quantization errors in gain.

Preferably, the short-term LPC analysis of speech is performed once every 22.5 msec by an open loop tenth-order covariance method analyzer. The ten LPC parameters produced are then converted to LSFs and the LSF vector is divided into two sub-vectors of dimensions 4 and 6. Each sub-vector is separately quantized using 10 bits each by minimizing a weighted distortion measure, the weights depending on the power level of original speech at the particular LSF. The codebooks for the two sub-vectors are independently designed based on the Linde, Buzo and Gray (LBG) algorithm using the Euclidian distance measure. Weighted distance/distortion measures preferably are not used for generating the codebooks in order to preserve the ordered property of LSFs within each quantized sub-vector. It will be noted that violation of the ordered property will lead to an unstable LPC synthesis filter 280.

As discussed previously, in order to preserve the ordered property of the combined LSF vector after quantization, only those codewords in conventional second codebooks that satisfy the ordered property are considered in arriving at the optimal quantized second sub-vector. However, such a method is inefficient, since only a portion of the second codebook will be eligible for quantizing the second sub-vector. The vocoder according to a preferred embodiment of the present invention avoids this inefficiency by populating the second codebook such that, for every possible choice of the first codeword, the total number of eligible codewords in the second codebook is 1024. This method is described in greater detail below.

Starting from a large training database, estimates were mode of the conditional probability of choosing a codeword from the second codebook, given the quantized value of the first sub-vector. The codeword from the second codebook that has the maximum likelihood of selection is then determined for each given quantized first sub-vector. If K is the number of eligible codewords (those that satisfy the ordered property) in the original second codebook for a given quantized first sub-vector, then 1024−K codewords are created using the following steps.

Let X(max) represent the codeword in the second codebook that has maximum likelihood of selection for a given first codeword from the first codebook. If K>512, then the number of codewords to be created is less than 512. In this case, 1024−K codewords are created by obtaining centroids of pairs of codewords in the second codebook of the form (X(max),X(i)), where X(i) is an eligible codeword in the second codebook and the sequence {X(i)}, i=1,2 . . . , 1024−K; i≠max, is ordered decreasingly based on the likelihood of selection.

For the case when K<512, more than 512 codewords need to be created. This is done in a multi-step procedure. In the first step, the centroids X1(i) of all pairs of the form (X(max),X(i)), i=1,2, . . . , K−1 are evaluated. In the second step, the centroids X2(i) of all pairs of the form (X(max), X1(i)) are evaluated. This procedure is continued until the second codebook is populated to 1024 codewords.

As shown in FIG. 3, an input speech signal is provided to transmitter 100 during step S10. A tenth order linear predictive coding is performed during step S20 and the linear predictive coding is transformed into line spectrum frequency coding during step S30. The output line spectrum frequency vector is then provided into a first sub-vector comprising four elements and a second sub-vector comprising six elements during step S40. During step S50, the first sub-vector is quantized in first vector quantizer 130 using 10-bits from a first codebook. Preferably, a codeword index is also generated in vector quantizer 130.

During step S60, the number of eligible codewords in the second codebook which satisfies the predetermined ordered property with the first codebook is determined. It will be appreciated that the actual number of eligible codewords are counted. During step S70, the codewords (X2[.]) in the second codebook are arranged in decreasing order of likelihood of selection. During step S80, the number of eligible codewords is compared with a predetermined number, preferably 512, which corresponds to half the number of possible codewords.

When the number of eligible codewords is greater than 512, the remaining codewords are computed by determining centroid of pairs maintaining the order property. When the number of eligible codewords is less than 512, a repeating subroutine is performed in response to the determination made in step S80. During step S110, the count value is initialized. During step S120, centroids of pairs having a first form are computed. A test is performed at step S130 to determine if the count value is equal to K(j1). If the answer is YES, the program steps to step S100 and ends. If the answer is NO, a determination is made as to whether the value i is equal to 1024−K(j). If the determination is NO, the program loops back to the beginning of step S120. However, if the answer is YES, i is set to K(j1) during step S150 before looping back to the beginning of step S120.

The method described above has several advantages. First, for a given codeword from the first codebook, the number of codewords in the second codebook is 1024. Hence, the second codebook efficiently utilizes the ten bits that are available for quantizing the second sub-vector. It will be appreciated that encoding using a second codebook populated according to the disclosed method can only perform better than or equal to the conventional encoding method without this populating method according to the present invention. It will also be noted that the second codebook populated according to an embodiment of the present invention adds new code words to the unpopulated regions of the original second codebook. In other words, all codewords found in the original second unpopulated codebook are still present when the populated codebook is created according to the present invention.

It will be noted that the codewords that are created to populate the second codebook are all ordered because of the centroid property. Hence, the synthesis filter will be stable. It will also be appreciated that all of codewords that are created are closer to the codeword that has the largest likelihood of selection. This has the effect of providing the increased resolution in the region of the input space of interest.

Additionally, is should be noted that the method advantageously can be made adaptive without transmitting additional information to the decoder during the testing phase. This can be achieved by the following steps. First, when a test LSF vector is presented to the split-vector quantizers 130, 140, the first sub-vector is quantized using the first codebook of size 1024. The second sub-vector is also quantized using a codebook of size 1024. Preferably, the second codebook being selected is based on the first codeword. Based on the information about the first and second codewords, the conditional probability of choosing a second codeword can be updated both at the encoder and decoder. Based on the conditional probability information, the populating method described above can be carried out both at the encoder and decoder. Thus, the populating method can be made adaptive at the arrival of each test LSF vector. It will be appreciated that an adaptive method is advantageous in cases where the joint statistics of selection of first and second sub-vectors are significantly different from that of a training database, and hence enables tracking.

Other modifications and variations to the invention will be apparent to those skilled in the art from the foregoing disclosure and teachings. Thus, while only certain embodiments of the invention have been specifically described herein, it will be apparent that numerous modifications may be made thereto without departing from the spirit and scope of the invention.

What is claimed is:

1. A vocoder responsive to an input signal to generate an encoded word, said vocoder including an input for receiving said input signal, and a multiplexer producing said encoded word transmitted via a transmission path to a receptive demultiplexer, wherein said vocoder comprises a first codeword generator generating a first codeword in accordance with a first sub-vector representing a first portion of said input signal, a second codeword generator generating a second codeword in accordance with a second sub-vector representing a second portion of said input signal, a pitch codeword generator generating a pitch codeword in accordance with said input signal and a gain codeword generator generating a gain codeword in accordance with said input signal, wherein said encoded word comprises said first, second, pitch and gain codewords and wherein said first and second codeword generators select said first and second codewords from respective first and second codebooks having an equal number of codewords and wherein said first and second codewords represent unequal numbers of elements of said first and second sub-vectors, respectively.

2. A vocoder responsive to an input signal to generate an encoded word, said vocoder including an input for receiving said input signal and a multiplexer producing said encoded word transmitted to a receptive demultiplexer, wherein said vocoder comprises a first codeword generator generating a first codeword in accordance with a first sub-vector representing a first portion of said input signal, a second codeword generator generating a second codeword in accordance with second sub-vector representing a second portion of said input signal, a pitch codeword generator generating a pitch codeword in accordance with said input signal and a gain codeword generator generating a gain codeword in accordance with said input signal, wherein said encoded word comprises said first, second, pitch and gain codewords, wherein said first and second codeword generators select said first and second codewords from respective first and second codebooks having an equal number of codewords:

wherein said gain codeword is based on a differential calculation with respect to a reconstructed gain determined during an immediately preceding first frame, wherein said pitch codeword is based on a differential calculation with respect to a reconstructed pitch determined during an immediately preceding second frame, and wherein said first and second codewords represent unequal numbers of elements of a vector represented by respective first and second sub-vectors.

3. The vocoder as recited in claim 2, wherein said vector includes a plurality of line spectral frequencies and wherein said first sub-vector represents a smaller number of said line spectral frequencies than said second sub-vector.

4. The vocoder as recited in claim 3, wherein said first and second codebooks maintain an ordered property between a selected first line spectrum frequency of said first sub-vector and a selected second line spectrum frequency of said second sub-vector.

5. A vocoder transmitting and receiving a plurality of codewords representing voice signals at a low bit rate, comprising:

a transmitter responsive to said voice signals for transmitting said codewords, said transmitter including:

a first vector quantizer receiving a predetermined first number of line spectral frequencies derived from said input signal and generating a first sub-vector codeword including a predetermined second number of bits;

a second vector quantizer receiving a predetermined third number of line spectral frequencies derived from said input signal and generating a second sub-vector codeword including said second number of bits;

a third quantizer generating differential pitch and differential gain respective codewords derived from said input signal, during a predetermined transmission period; and a multiplexer for combining said first sub-vector codeword, said second sub-vector codeword, said differential pitch codeword and said gain code word into an encoded word for transmission; and a receiver including:

a demultiplexer responsive to said encoded word for generating a recovered differential pitch codeword, a recovered gain codeword, and recovered first and second sub-vector codewords.

6. The vocoder as recited in claim 5, wherein said third quantizer generates a reference pitch codeword in response to a transition between an unvoiced utterance and a voiced utterance in said input signal, and wherein said reference pitch codeword is transmitted before transmission of any differential pitch codewords for a respective voiced utterance.

7. The vocoder as recited in claim 5, wherein said third number is greater than said first number and wherein a selected one of said first number of line spectral frequencies and a selected one of said third number of line spectral frequencies maintain an ordered property with respect to one another.

8. The vocoder as recited in claim 5, wherein said receiver further comprises a filter receiving linear prediction coding information corresponding to said recovered first and second sub-vector codewords for generating output speech.

9. The vocoder as recited in claim 5, wherein said receiver further comprises:

a pitch decoder for generating reconstructed pitches;

an impulse train generator responsive to non-zero reconstructed pitches for generating an impulse train;

a random noise generator responsive to zero reconstructed pitches for generating a random noise signal; and a switch responsive to said differential pitch for selectively switching between said impulse train and said random noise signal.

10. In a vocoder responsive to an input signal to generate an encoded word, said vocoder including a multiplexer producing said encoded word transmitted to a receptive demultiplexer, wherein said vocoder comprises a first codeword generator generating a first codeword in accordance with a first portion of said input signal, a second codeword generator generating a second codeword in accordance with a second portion of said input signal, a pitch codeword generator generating a pitch codeword in accordance with said input signal, and a gain codeword generator generating a gain codeword in accordance with said input signal, a method for generating said encoded word comprising the steps of:

selecting said first and second codewords in accordance with respective first and second portions of said input signal from respective first and second codebooks having a equal number of codewords;

generating said gain codeword based on a differential calculation with respect to a reconstructed gain determined during an immediately preceding first frame; and generating said pitch codeword based on a differential calculation with respect to a reconstructed pitch determined during an immediately preceding second frame; and combining said first, second, pitch and gain codewords in said multiplexer to form said encoded word, wherein said first and second codewords represent unequal numbers of elements of a vector represented by respective first and second sub-vectors.

11. The encoded word generating method as recited in claim 10, wherein said vector includes a plurality of line spectral frequencies and wherein said first sub-vector includes a smaller number of said line spectral frequencies than said second sub-vector.

12. The encoded word generation method as recited in claim 11, wherein said first and second codebooks maintain an ordered property between a selected first line spectrum frequency of said first sub-vector and a selected second line spectrum frequency of said second sub-vector.

* * * * *